US008276424B2

(12) United States Patent
Yamane

(10) Patent No.: US 8,276,424 B2
(45) Date of Patent: Oct. 2, 2012

(54) GROOVED ROLL FOR A REDUCER AND A REDUCER

(75) Inventor: Akihito Yamane, Kyoto (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 480 days.

(21) Appl. No.: 12/461,323

(22) Filed: Aug. 7, 2009

(65) Prior Publication Data

US 2010/0031725 A1 Feb. 11, 2010

Related U.S. Application Data

(63) Continuation of application No. PCT/JP2008/052172, filed on Feb. 8, 2008.

(30) Foreign Application Priority Data

Feb. 8, 2007 (JP) ..... 2007-029480

(51) Int. Cl.
*B21B 27/02* (2006.01)
*A01B 29/04* (2006.01)

(52) U.S. Cl. ..... 72/252.5; 492/1; 492/37

(58) Field of Classification Search ..... 72/252.5, 72/236, 224, 100; 492/1, 28, 30, 37
See application file for complete search history.

(56) References Cited

U.S. PATENT DOCUMENTS

2002/0100307 A1* 8/2002 Narita et al. ..... 72/236

FOREIGN PATENT DOCUMENTS

| | | |
|---|---|---|
| JP | 63-260606 | 10/1988 |
| JP | 7-314013 | 12/1995 |
| JP | 8-19808 | 1/1996 |
| JP | 11-151506 | 6/1999 |
| JP | 2000-158015 | 6/2000 |
| JP | 2000-334504 | 12/2000 |
| JP | 2001-71012 | 3/2001 |
| JP | 2001-129603 | 5/2001 |
| JP | 2003-19503 | 1/2003 |
| JP | 2005-46874 | 2/2005 |
| JP | 2005-169466 | 6/2005 |
| JP | 2005-305447 | 11/2005 |

* cited by examiner

*Primary Examiner* — Debra Sullivan

(74) *Attorney, Agent, or Firm* — Clark & Brody

(57) ABSTRACT

A pipe in which polygonization is substantially eliminated is manufactured by a reducer with a grooved roll with a groove having a groove bottom zone including the center of the groove in the roll axial direction and flange zones adjoining both sides of the groove bottom zone. The groove surface has a friction distribution in the roll axial direction such that the frictional force with respect to a material being rolled in the groove bottom zone is larger than the frictional force with respect to a material being rolled in the flange zones. This friction distribution can be achieved by working the groove surface so that the surface roughness of the groove bottom zone becomes greater than the surface roughness of the flange zones or by applying a lubricity modifier which differs with respect to amount and/or type between the groove bottom zone and the flange zones.

4 Claims, 10 Drawing Sheets

Effect of producing friction distribution in rolls ('12, abscissa: Stand#; lefthand ordinate: Variation of radial dimensions; righthand ordinate: Amont of wall thickness deviation)

Effect of producing friction distribution in rolls (†8, abscissa: Stand#; lefthand ordinate: Variation of radial dimensions; righthand ordinate: Amont of wall thickness deviation)

Effect of producing friction distribution in rolls ('3, abscissa: Stand#; lefthand ordinate: Variation of radial dimensions; righthand ordinate: Amont of wall thickness deviation)

GROOVED ROLL FOR A REDUCER AND A REDUCER

This application is a continuation of International Patent Application No.

PCT/JP2008/052172 filed Feb. 8, 2008. This PCT application was not in English as published under PCT Article 21(2).

TECHNICAL FIELD

This invention generally relates to a grooved roll for a reducer (reducing mill) and to a reducer which are used for manufacturing pipes. More particularly, the present invention relates to a grooved roll for a reducer and to a reducer which can markedly suppress uneven variations in the circumferential distribution of thickness increases, which are a direct cause of the occurrence of polygonization, and which can thereby essentially eliminate the occurrence of polygonization even when a plurality of types of pipes differing in parameters such as wall thickness, outer diameter, and material are subjected to reducing under different conditions.

BACKGROUND ART

Sizers and stretch reducers, which are the most common types of reducers, are normally constituted by a plurality of pipe rolling stands (such as 8-28 stands) installed in tandem, with each stand being equipped with grooved rolls of the two-roll or three-roll type. For example, in the three-roll reducing method using grooved rolls of the three-roll type, the grooved rolls are installed in each stand so that the grooved rolls in adjoining stands have a phase angle (phase difference) of 60 degrees with respect to each other. A pipe undergoes rolling by passing through the groove (pass) formed from the grooved rolls each having an elliptical groove shape with no tool being inserted into the interior of the pipe and in the case of a stretch reducer with tension being applied to the pipe between adjoining stands. The rolling greatly decreases the outer diameter of the pipe, with the wall thickness generally increasing in the case of a sizer and generally decreasing in the case of a stretch reducer. In the two-roll reducing method using grooved rolls of the two-roll type in each stand, there is a phase difference of 90 degrees between the grooved rolls of adjoining stands.

Because the roll grooves each have an elliptical shape, a pipe which is subjected to reducing by grooved rolls is strongly deformed in the central portion in the axial direction of each grooved roll (referred to as the groove bottom zone), and the rolling force decreases towards both end portions of the groove (the end portions of the flange zones on both sides of the groove bottom zone). Since a tool is not present in the interior of the pipe, when the pipe is subjected to several passes through rolling stands, so-called polygonization takes place. Polygonization is a phenomenon in which the transverse cross-sectional shape of the inner surface of a pipe becomes hexagonal (or tetragonal in a two-roll reducing method).

A pipe which has developed polygonization has a polygonal transverse cross-sectional shape on its inner surface, but the outer surface of the pipe which has been finished in the reducer is nearly circular. Therefore, the wall thickness of the pipe exhibits wall thickness variations (thickness deviations) in which the wall thickness periodically increases or decreases in the circumferential direction (three or six times in the case of three-roll reducing). Polygonization is known to occur particularly easily when carrying out rolling with a reducer of a pipe having an intermediate or large wall thickness in which the ratio of the finished wall thickness to the finished outer diameter is 8% or greater.

As described in below-listed Patent Documents 1 and 2, the degree of this polygonization varies with the rectangularity of a roll groove, which is expressed by the ratio (CLE/CLG) of the distance CLE from the edge portion entrance surface to the roll exit surface with respect to the distance CLG from the roll groove bottom entrance surface to the roll exit surface. A known countermeasure against polygonization is the rectangularity design method in which the rectangularity is suitably selected.

Patent Document 3 discloses suppressing polygonization by suitably setting the amount of working in each stand of a plurality of roll stands having grooved rolls. Patent Document 4 discloses minimizing polygonization by setting the rotational speed of grooved rolls in each stand to a suitable value so that the overall elongation of a rolled pipe is made uniform by controlling the rotational speed of drive motors which rotationally drive the grooved rolls in each stand of a stretch reducer.

Patent Document 5 discloses suppressing polygonization by water cooling of portions of a pipe during reducing of the pipe. Patent Documents 6 and 7 disclose suppressing polygonization during sizing rolling by adjusting the roll position in each stand. Patent Documents 8-10 disclose suppressing polygonization by suitably setting the phase angle of the rolls in each stand during reducing of a pipe.

Patent Document 1: JP H07-314013 A1
Patent Document 2: JP H08-19808 A1
Patent Document 3: JP H11-151506 A1
Patent Document 4: JP 2001-71012 A1
Patent Document 5: JP 2001-129603 A1
Patent Document 6: JP 2000-158015 A1
Patent Document 7: JP 2000-334504 A1
Patent Document 8: JP 2005-46874 A1
Patent Document 9: JP 2005-305447 A1
Patent Document 10: JP 2005-169466 A1

However, with the techniques disclosed in Patent Documents 1-3, the amount of polygonization, which varies in accordance with conditions such as the wall thickness and tension of a pipe, cannot always be suppressed to a constant range under all conditions. Similarly, the techniques disclosed in Patent Documents 4, 6, and 7 can only slightly decrease the amount of polygonization which occurs, and they cannot suppress polygonization to a fixed range regardless of variations in conditions.

The technique disclosed in Patent Document 5 is premised on variation in the heating of a pipe being the main cause of polygonization. However, if the temperature of a pipe during rolling is locally decreased by water cooling, cooling water unavoidably splashes or flows to portions other than the desired portion, and it is extremely difficult to control the temperature only of a specific portion of a pipe. Accordingly, it is thought to be difficult to stably suppress polygonization with this technique.

In order to carry out the techniques disclosed in Patent Documents 8-10, it is necessary to adjust the phase angle of the grooved rolls of each stand. For this purpose, it is necessary to change the conditions for reducing, and the rectangularity of a groove, which is a direct cause of polygonization, fluctuates, so this method cannot stably suppress polygonization.

DISCLOSURE OF INVENTION

Thus, when reduction of a plurality of types of pipes having different parameters such as wall thickness is carried out in a stretch reducer under different conditions using a conventional method as disclosed in Patent Documents 1-10, it is extremely difficult to stably suppress polygonization to an extent that it is essentially eliminated. The present invention provides a grooved roll for a reducer which solves such problems.

A grooved roll for a reducer according to the present invention has a groove having a groove bottom zone including the center in the roll axial direction and flange zones adjoining both sides of the groove bottom zone, characterized in that the surface of the groove has a friction distribution in the roll axial direction such that the frictional force with respect to a material being rolled in the groove bottom zone is greater than the frictional force with respect to a material being rolled in the flange zones.

In this context, the "groove bottom zone" of the groove of a grooved roll means the region which is deeper than the midpoints of the angles between the deepest point of the groove (normally the center point in the axial direction of the groove) and the shallowest points of the groove (normally both ends of the groove) as viewed from the center of the stand (the midpoints being at the intersection between a line bisecting the angle and the surface of the groove). In this context, the "flange zones" of the groove of a grooved roll mean the two regions on both sides of the groove bottom zone remaining after removing the groove bottom zone from the groove, namely, the two side regions which are shallower than the midpoints of the angles between the deepest point and the shallowest points as viewed from the center of the stand.

The term "roll axial direction" as used herein naturally means the direction of the rotational axis of a grooved roll which is rotationally driven. In the case of grooved rolls of the three roll type, the three grooved rolls have roll axial directions which are at 120 degrees with respect to each other.

When the frictional force between the roll surface and a material being rolled in the groove bottom zone is not constant but varies in the roll axial direction in the groove bottom zone, the average value thereof is considered the frictional force in the groove bottom zone. In this case, the frictional force is preferably highest at the center of the groove bottom zone in the roll axial direction. Similarly, when the frictional force in the flange zones of the groove varies, the average value is used as the frictional force.

In a grooved roll for a reducer according to the present invention, the groove bottom zone of the groove preferably has a greater surface roughness than the flange zones, whereby the above-described friction distribution is formed. The surface roughness of the groove bottom zone and the flange zones is made the average value of each when the surface roughness varies in these regions.

From another standpoint, the present invention is a reducer characterized by having the above-described grooved roll according to the present invention and a is friction distribution producing means for producing the above-described friction distribution in the roll axial direction on the groove surface.

The means for producing a friction distribution in the roll axial direction in a reducer can be (a) a surface working device which can work the peripheral surface regions of at least a portion in the axial direction of the groove surface such that the surface roughness of the groove bottom zone of the groove is different from the surface roughness of the flange zones, or (b) a lubricity modifier applicator which can apply a lubricity modifier to the peripheral surface region of at least a portion in the axial direction of the groove surface so that the applied amount and/or the type of a lubricity modifier differs between the groove bottom zone and the flange zones.

The surface working device is preferably an on-line roll grinding machine which can perform grinding of a grooved roll while it remains mounted on a reducer. A lubricity modifier is intended to encompass both a lubricant (antifriction or friction decreasing agent) and an antislipping (friction increasing) agent.

According to the present invention, buildup of the circumferential distribution of wall thickness increases, which is a direct cause of the occurrence of polygonization, can be radically improved. As a result, the occurrence of polygonization can be essentially eliminated even when a plurality of types of pipes having different parameters such as wall thickness, outer diameter, or material undergo reducing under different conditions.

BEST MODE FOR CARRYING OUT THE INVENTION

Below, a grooved roll for a reducer and a reducer according to the present invention will be explained more concretely while referring to the accompanying drawings. A three-roll stand with grooved rolls which is the most common type used in a reducing mill will be taken as an example, but a grooved roll for a reducer according to the present invention can be similarly applied to a grooved roll of a two-roll or four-roll stand with grooved rolls.

Figure 1:
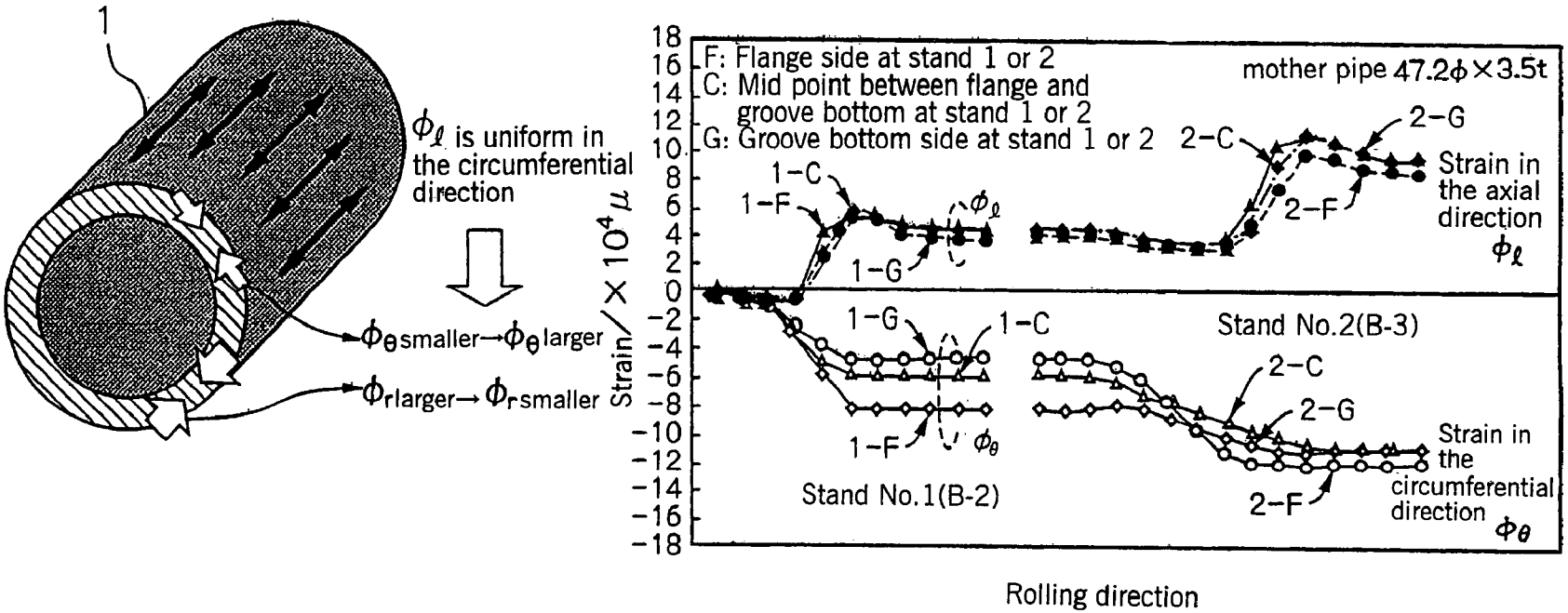
FIG. 1 is an explanatory view showing the relationship between the strain in the axial direction and the strain in the circumferential direction which develop in a pipe during reducing.

FIG. 1 is an explanatory view showing the relationship between the strain in the axial direction $\phi_1$ and the strain in the wall thickness direction $\phi_r$ which develop in a pipe 1 during reducing, taking rolling in the first stand and the second stand as an example.

As shown in this figure, the fact that the axial strain $\phi_1$ of a pipe 1 is nearly uniform around the entire periphery in the circumferential direction can be seen from the upper half of the graph of FIG. 1 which shows the strain (elongation) in the pipe axial direction because the plots for 1-F, 1-C, and 1-G are nearly superimposed and the plots for 2-F, 2-C, and 2-G are also nearly superimposed. On the other hand, from the lower half of the graph in FIG. 1 which shows the strain (compression) in the circumferential direction of the pipe 1, it can be seen that the strain in the circumferential direction $\phi_\theta$ varies in the circumferential direction in a transverse cross section of the pipe 1. Since the volume of the pipe does not change, the sum of the strain in the axial direction of the pipe and the strain in the circumferential direction and the strain in the thickness direction is a constant value. Accordingly, the strain in the thickness direction $\phi_r$ also varies in the circumferential direction in a transverse cross section of the pipe 1. Namely, in the lower half of the graph of FIG. 1, the plots for 1-F, 1-C, and 1-G and those for 2-F, 2-C, and 2-G greatly differ from each other at the groove bottom zone, the flange zones, and a point midway between them, particularly from the start of rolling in the first stand to the completion of rolling in the second stand. From this figure, it can be deduced that an increase in thickness develops midway between the groove bottom zone and the flange zones where compressive strains are smaller than in the groove bottom zone.

The present inventors discovered that the non-uniform pattern of the distribution of strains in the thickness direction, namely, the distribution of increases in wall thickness can be changed by varying the coefficient of friction on the flange zones of a grooved roll and the coefficient of friction of the groove bottom zone, and they discovered that by utilizing this phenomenon, the circumferential distribution of wall thickness increases, which is a direct cause of the occurrence of polygonization, can be suppressed.

Figure 2:
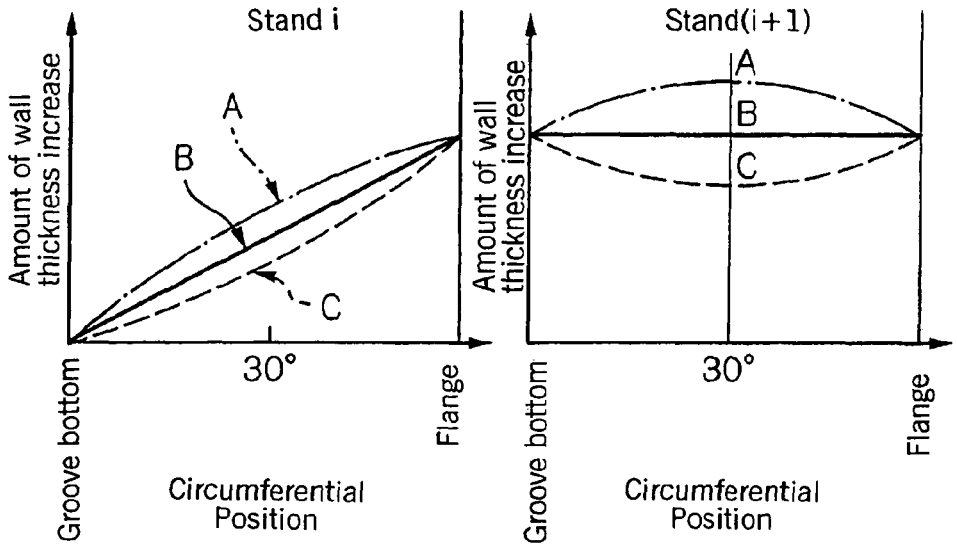
FIG. 2 is an explanatory view showing the circumferential distribution of the amount of wall thickness increase which develops in a pipe in stand i and in stand i+1 immediately downstream thereof during rolling in a reducer.

FIG. 2 is an explanatory view showing the distribution in the circumferential direction of a pipe of the increase in wall thickness which develops after carrying out reducing in a given stand i other than the final stand and the distribution in the circumferential direction of a pipe of the increase in wall thickness which develops after carrying out reducing in stand (i+1) which is one stand downstream thereof when three different patterns (A-C) of the coefficient of friction distribution in the roll axial direction of a groove of a grooved roll were employed. In the figures, the groove bottom on the abscissa is the center of the groove bottom zone where it is deepest, and the flanges mean the end portions of the groove (the flange end portions). The abscissa shows the position in the circumferential direction of the pipe from the groove bottom towards one of the flanges, with the groove bottom being at 0 degrees and the flange end portion being at 60 degrees.

Using FIG. 2, the manner in which polygonization (formation of a hexagonal shape) takes place and the pattern of polygonization which results can be explained. Pattern C indicates the case in which the coefficient of friction in the roll axial direction is not adjusted and which has a groove shape which is determined by a conventional design method using rectangularity as a design parameter as disclosed in the above-described patent documents. The pattern of the increase in wall thickness from the groove bottom towards the flange end portions is represented by a concave curve. If the coefficient of friction of the groove bottom zone is gradually increased while using a groove having the same shape as the groove used to produce pattern C, the pattern of the increase in wall thickness changes to pattern B and then to pattern A. If the increase in wall thickness of pattern C accumulates in each stand, the variation in the amount of wall thickness increase in stand i+1 shown in the right figure accumulates, and petal-shaped polygonization develops in the pipe at the completion of reducing. On the other hand, if a wall thickness increase of pattern A accumulates in each stand, star-shaped polygonization develops in the pipe at the completion of reducing. In contrast, even if a wall thickness increase of pattern B accumulates in each stand, as shown by the amount of wall thickness increase in stand i+1, the amount of wall thickness increase is uniform from the groove bottom to the flange and polygonization does not develop.

Based on this knowledge, when carrying out reducing of a pipe using a grooved roll according to the present invention, by making the frictional force between the roll surface and a material being rolled in the groove bottom zone of a groove larger than the frictional force between the roll surface and a material being rolled in the flange zones of a groove by a convenient means, namely, by imparting a coefficient of friction distribution to the surface of the groove such that the coefficient of friction in the flange zones is smaller than the coefficient of friction in the groove bottom zone, the range of variation of the distribution of wall thickness increase in the circumferential direction of a pipe, which is a direct cause of polygonization, can be minimized even if reducing is carried out on pipes having different wall thicknesses under different conditions. As a result, polygonization can be reduced and essentially eliminated.

Next, some preferred embodiments of a grooved roll for a reducer according to the present invention and a reducer equipped with such rolls will be explained.

First Embodiment

A grooved roll for a reducer of this embodiment has a groove in which the groove surface has a coefficient of friction varying in the roll axial direction. Namely, the groove surface has a friction distribution in the roll axial direction such that the coefficient of friction in the groove bottom zone including the center in the roll axial direction is larger than the coefficient of friction in the flange zones on both sides of the groove bottom zone.

Figure 3:
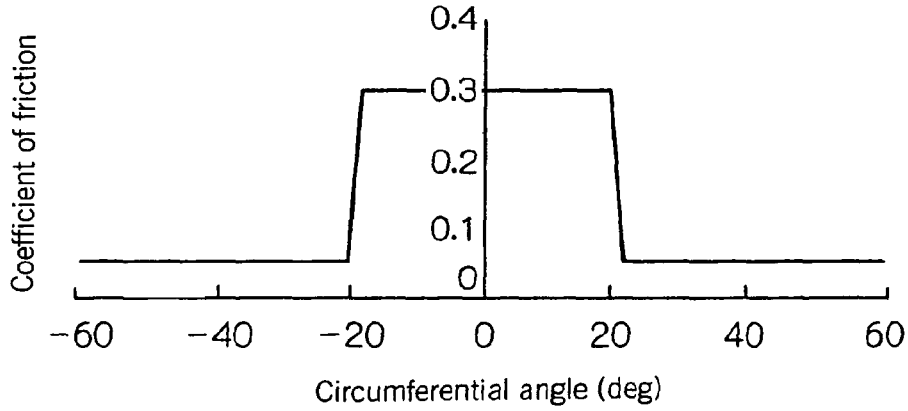
FIG. 3 is an explanatory view showing one example of the friction distribution in the roll axial direction on the groove surface in a first embodiment.

FIG. 3 is a graph showing an example of such a friction distribution. This friction distribution is imparted to a roll in an example which exhibits the effects of a below-described embodiment. The "circumferential angle" in the figure is the angle when the surface of the groove is viewed along the circumference of the pipe from the pipe axis. 0 degrees means the deepest location of the groove bottom zone of the groove. In a grooved roll for a three-roll stand, the angle in the circumferential direction of both flange ends is ±60 degrees.

In the illustrated example, the surface of the groove of the grooved roll has a friction distribution in the roll axial direction such that the coefficient of friction which produces a frictional force in at least a portion of the groove bottom including the center in the roll axial direction is 0.3 and the coefficient of friction which produces a frictional force in the flange zones on both adjoining sides of the groove bottom zone is 0.1. The portions of the groove bottom zone close to the flange zones have a coefficient of friction of 0.1, but on average, the coefficient of friction of the groove bottom zone is larger than the coefficient of friction of the flange zones, which is 0.1.

The friction distribution in the roll axial direction of the groove surface of a grooved roll is not limited to one which varies in a step-wise manner as shown in the graph of FIG. 3. In fact, based on the above-described findings, the friction distribution shown in FIG. 4 in which the coefficient of friction gradually decreases from the center in the roll axial direction towards the end portions, or the friction distribution shown in FIG. 5 in which the coefficient of friction gradually decreases from the center in the roll axial direction to some point on the flanges and then remains constant at a low level is preferable.

Figure 4:
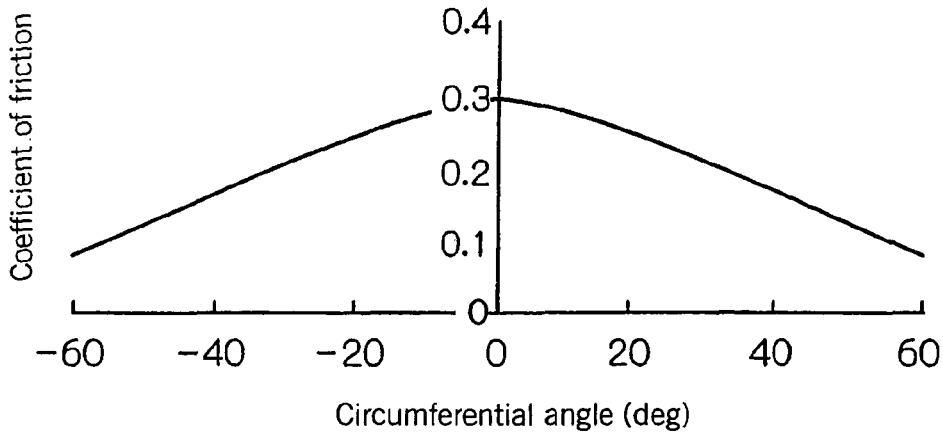
FIG. 4 is a view similar to FIG. 3 showing another example of a friction distribution.
Figure 5:
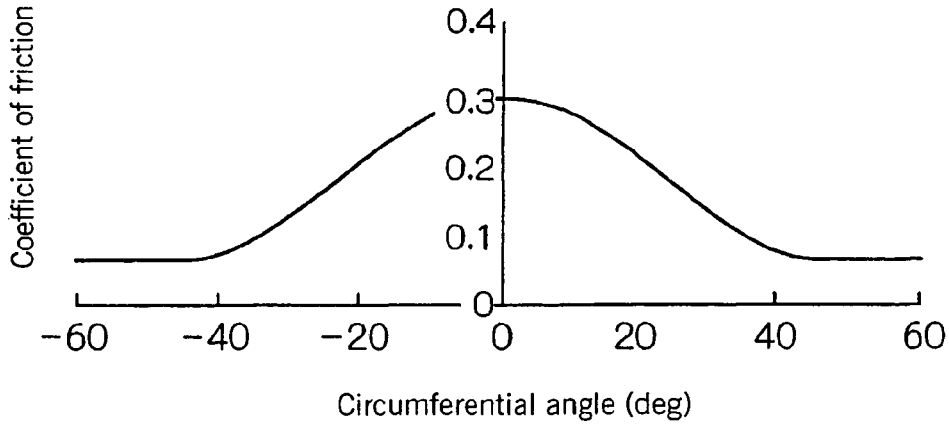
FIG. 5 is a view similar to FIG. 3 showing yet another example of a friction distribution.

The graphs in FIGS. 3-5 are examples of cases in which the maximum value of the coefficient of friction is set at 0.3. However, the maximum value of the coefficient of friction does not need to be 0.3, and it can be made a different value such as 0.4 or 0.25. In addition, these graphs show the case in which the minimum value of the coefficient of friction is set to 0.1, but the minimum value does not need to be 0.1, and it can be made another value such as 0.05 or 0.15.

In this embodiment, it is not necessary to limit the values of the coefficient of friction to specific ranges as long as the distribution of the coefficient of friction of the surface of the groove can be adjusted so that the frictional force of the roll surface in the groove bottom zone including the center in the roll axial direction is larger than the frictional force of the roll surface in the flange zones adjoining the groove bottom zone.

As stated above, when the coefficient of friction of the surface of the groove of a grooved roll varies, for example, as shown in FIG. 4 or FIG. 5, the coefficient of friction is the average value for both the groove bottom zone and the flange zones. Namely, the average values of the coefficients of friction in the groove bottom zone and the flange zones can be compared with each other, and it is sufficient for the coefficient of friction of the groove bottom zone to be larger than the coefficient of friction of the flange zones. In order to adequately achieve the effects of the present invention, the difference between the average value of the coefficient of friction in the groove bottom zone and the average value thereof in the flange zones is preferably at least 0.05.

In a grooved roll for a reducer according to this embodiment, a grooved roll having the above-described friction distribution can be obtained by making the surface roughness of the groove bottom zone of the groove including the center in the roll axial direction larger than the surface roughness of the flange zones on both sides of the groove bottom zone.

Figure 6:
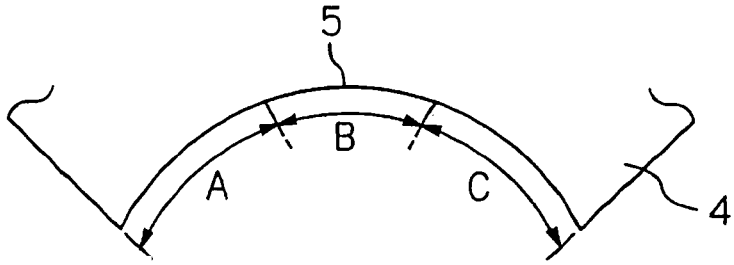
FIG. 6 is an explanatory view showing the case when the groove surface of a grooved roll is divided in the circumferential direction of the groove and different surface working is carried out on the different divided regions.

For example, as shown by the cross section in FIG. 6, if the circumference of the groove of a grooved roll for a reducer (the length of the peripheral surface of the groove measured in the circumferential direction of a pipe) is divided into three equal regions A, B, and C in the circumferential direction of the pipe and surface roughening of the surface of the groove is carried out only with respect to region B which is located in the center and which includes the center of the groove circumference where the groove is deepest, a friction distribution in the roll axial direction can be achieved such that the frictional force in region B is greater than the frictional force in region A or C.

However, the present invention is not limited to such a mode in which the distribution of the coefficient of friction has three equally divided regions, and it can have 3 regions, one of which comprises all or a portion of the groove bottom zone including the center in the roll axial direction, the other two regions including the flange zones which adjoin the groove bottom zone (and which may include the remainder of the groove bottom zone). In this case, a step-wise friction distribution like that shown in FIG. 3 is formed.

Surface roughening of the groove surface in region B can be carried out by initial masking of regions other than the central region B, i.e., the two regions A and C positioned at both ends of region B, and then carrying out shot blasting. It is also possible to carry out a method in which lattice-shaped surface scratches with each unit of the lattice having a length of 3 mm, for example, on a side are imparted with a grinder, or a method in which the below-described machining is carried out to form surface irregularities.

A grooved roll for a reducer according to this embodiment can be manufactured by performing working of the groove surface such that the surface roughness varies in the roll axial direction in a manner as described above. Examples of a means for such roll surface working are shot blasting and grinding. The surface roughness may also be previously afforded to the roll surface by a mechanically working means such as dimple formation or grid formation.

These methods of surface working can be suitably combined to make the surface roughness of at least a portion of the groove bottom zone including the center in the roll axial direction larger than the surface roughness of the flange zones on both sides adjoining this groove bottom zone. The groove surface of the roll may initially be worked by machining with a lathe to obtain a mirror surface, and then the above-described various types of surface working are employed in combination to form minute irregularities on the surface of the groove such that the shape of the irregularities varies along the roll axial direction. As viewed microscopically, these irregularities increase frictional force by catching on a pipe, resulting in the formation of a friction distribution in such a manner that the frictional force with respect to a pipe varies in the roll axial direction. A grooved roll having a friction distribution in the roll axial direction which gradually varies on the surface of the groove as shown in FIG. 4 or FIG. 5 can also be formed by machining and/or surface working.

A grooved roll for a reducer according to this embodiment has a friction distribution such that the frictional force with respect to a pipe is not constant in the roll axial direction. Instead, the frictional force with respect to a pipe in the groove bottom zone including the center in the roll axial direction is larger than the frictional force with respect to the pipe in the flange zones adjoining the groove bottom zone. As a result, metal flow particularly in the direction towards the flanges can be suppressed, whereby a suitable distribution in the circumferential direction of the wall thickness increase is attained and the occurrence of polygonization is suppressed.

It is of course desirable to suppress metal flow in the circumferential direction over the entire circumference of a pipe. However, if the frictional force is excessively decreased, a material to be rolled can no longer be gripped by a roll. Therefore, the groove bottom zone preferably exerts a suitable frictional force. From this standpoint, the coefficient of friction with respect to a material being rolled of the roll surface at the center of the groove bottom zone preferably has an average value of at least 0.2.

A reducer according to this embodiment comprises the above-described grooved roll and a friction distribution producing means for producing the above-described friction distribution.

The friction distribution producing means can be a surface working device which can perform working such that the groove bottom zone including the center in the roll axial direction of a groove and the flange zones adjoining both sides of the groove bottom zone have different levels of surface roughness.

This surface working device is preferably an on-line roll grinding machine or surface working device which can perform grinding of a grooved roll while the roll remains mounted on a reducer. The surface condition of the groove of a grooved roll of a reducer varies as the grooved roll is used. As surface bumps wear with time, irregularities in the surface (the surface roughness) gradually decrease. Therefore, in this embodiment, the time at which the height or the depth of irregularities in the roll surface of a groove decreases to a predetermined value or less or the time at which the effect of suppressing thickness variations markedly decreases is empirically determined based on the relationship between the number of roll passes and the change in the roll surface condition. Based on this empirical value, the timing of grinding is determined, and based on this timing, surface working is carried out on the groove of a grooved roll in an on-line state using the on-line grinding machine or surface working device such that the surface roughness and accordingly the frictional force exerted by the groove bottom zone becomes greater than that exerted by the flange zones. It is usually sufficient to carry out this surface working only on the groove bottom zone, but if necessary, it can also be carried out on the flange zones.

Figure 7:
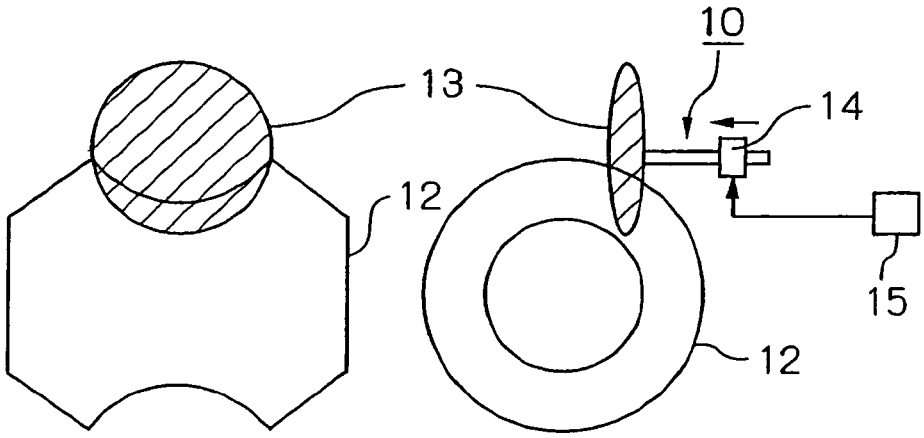
FIG. 7 is an explanatory view schematically showing an example of an on-line roll grinding machine.
Figure 8:
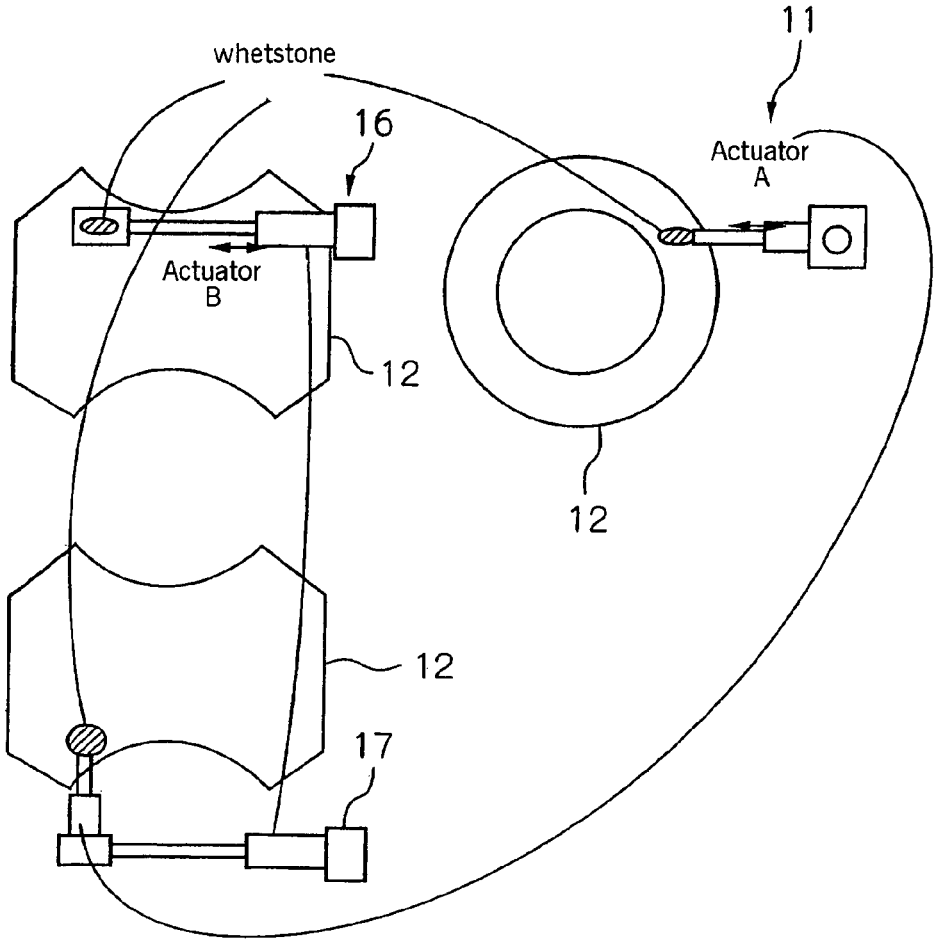
FIG. 8 is an explanatory view schematically showing another example of an on-line roll grinding machine.

FIGS. 7 and 8 are explanatory views schematically showing on-line roll grinding machines 10 and 11, respectively, which can be used in this embodiment. These on-line roll grinding machines 10 and 11 are both illustrative, and it is possible to use ones of a different structure which can perform grinding of the roll surface along the groove of a grooved roll 12 in an on-line state. Both of these examples perform grinding when a pipe is not passing thereby. During a normal manufacturing process for a seamless pipe, the length of time for which rolling is performed in each stand of a reducer is around 5 seconds, while the rolling pitch is from 10 seconds to several tens of seconds. Therefore, there are at least 5 seconds of waiting time for the stand. The roll surface of a groove roll can be subjected to grinding during this waiting time.

The on-line roll grinding machine 10 shown in FIG. 7 uses an actuator 14 to adjust the amount of grinding using a whetstone 13 having the same shape as is used for roll grinding. The amount of forward movement of the actuator 14 is controlled based on the amount of forward movement output by a computer 15 to start roll grinding, and roll grinding is terminated by retracting the whetstone 13 using the actuator 14.

As shown in this example, in a preferable system, the actuator 14 and the computer 15 are connected by a network, and the movement, the operational timing, and the like of the actuator 14 are controlled by the computer 15.

The on-line grinding machine 11 shown in FIG. 8 comprises an on-line grinding machine 16 which is typically used in plate rolling, and an actuator 17 for moving the grinding machine 16 in the direction of the roll groove. The grinding position can be controlled biaxially (in two axial directions). Grinding is started by advancing a whetstone using the actuator 17, and grinding is terminated by retracting the whetstone using the actuator 17.

In either of these cases, the actuator is preferably connected to a computer by a network, and the movement and operational timing of the actuator are controlled by the computer. In either of these cases, the grinding machine which is used is one which can grind at least a portion of the groove bottom zone of a grooved roll and which can impart a desired surface roughness with the whetstone mounted on the grinding machine. Such an on-line grinding machine is preferably provided on all of the stands, but it is also possible for one on-line grinding machine to be shared by all the stands or by a plurality of stands. It is also possible to use two or more types of whetstones so as to impart different surfaces to the groove bottom zone and the flange zones such that the surface roughness of the groove bottom zone is greater.

In this embodiment, when it is still not possible to prevent polygonization by a method of imparting a friction distribution to the roll surface according to this invention, the effect of suppressing polygonization is preferably supplemented by suitably varying the operational parameters such as the stretch of the overall rolling mill, the rotational speed of the rolls, or the like in accordance with conventional operational design techniques. When applying a lubricant to the grooved rolls of any of the stands, the lubricant may be uniformly applied to the surface of grooved rolls. Alternatively, as explained below for a second embodiment, it is possible to vary the applied amount or the type of a lubricant.

Second Embodiment

A grooved roll for a reducer according to this embodiment is different from the above-described first embodiment in that the surface roughness of the groove of a grooved roll may be the same in the groove bottom zone including the center in the roll axial direction and in the flange zones adjoining both sides of the groove bottom zone. Namely, the surface of the groove may have a uniform overall surface roughness. Instead, the amount of lubricant applied to the roll surface in a portion of the groove bottom zone including at least the center of the groove in the roll axial direction is made smaller than the amount applied to the roll surface in the flange zones. As a result, the groove surface has a friction distribution in the roll axial direction such that the frictional force in the groove bottom zone is larger than the frictional force in the flange zones.

Such a friction distribution can be achieved not only by varying the applied amount of a lubricant but by varying the type of lubricant, namely, by applying a lubricant having a higher lubricity (having a greater friction reducing effect) to the flange zones and applying a lubricant having a lower lubricity or applying a friction increasing agent (anti-slipping agent) to the groove bottom zone. Namely, application can be carried out using at least one type of lubricity modifier selected from lubricants and friction increasing agents. It is also possible to vary both the type and applied amount of a lubricity modifier.

In a reducer according to this embodiment, a lubricity modifier applicator which can perform application of a lubricity modifier such that the applied amount and/or type of a lubricity modifier in a portion in the roll axial direction of the groove bottom zone including at least the center of the groove is different from the applied amount and/or the type of a lubricity modifier in the flange zones is provided as a means of producing a friction distribution. This lubricity modifier applicator can be any type which can apply a lubricity modifier to the surface of a groove, such as one which performs application by spraying, while imparting variations in accordance with the position in the roll axial direction of a grooved roll.

For example, the lubricity modifier applicator may be equipped with a lubricity modifier spraying unit which sprays a lubricity modifier and a cooling water removing unit which blows away roll cooling water which is present on the roll surface in order to ensure that the lubricity modifier adheres to the roll surface. A lubricity modifier spraying unit can spray a lubricity modifier in an amount which varies in accordance with the position in the roll axial direction of a groove or which sprays a lubricity modifier only at a portion of a groove (namely, at least a portion of the groove bottom zone including the center in the roll axial direction).

Figure 9:
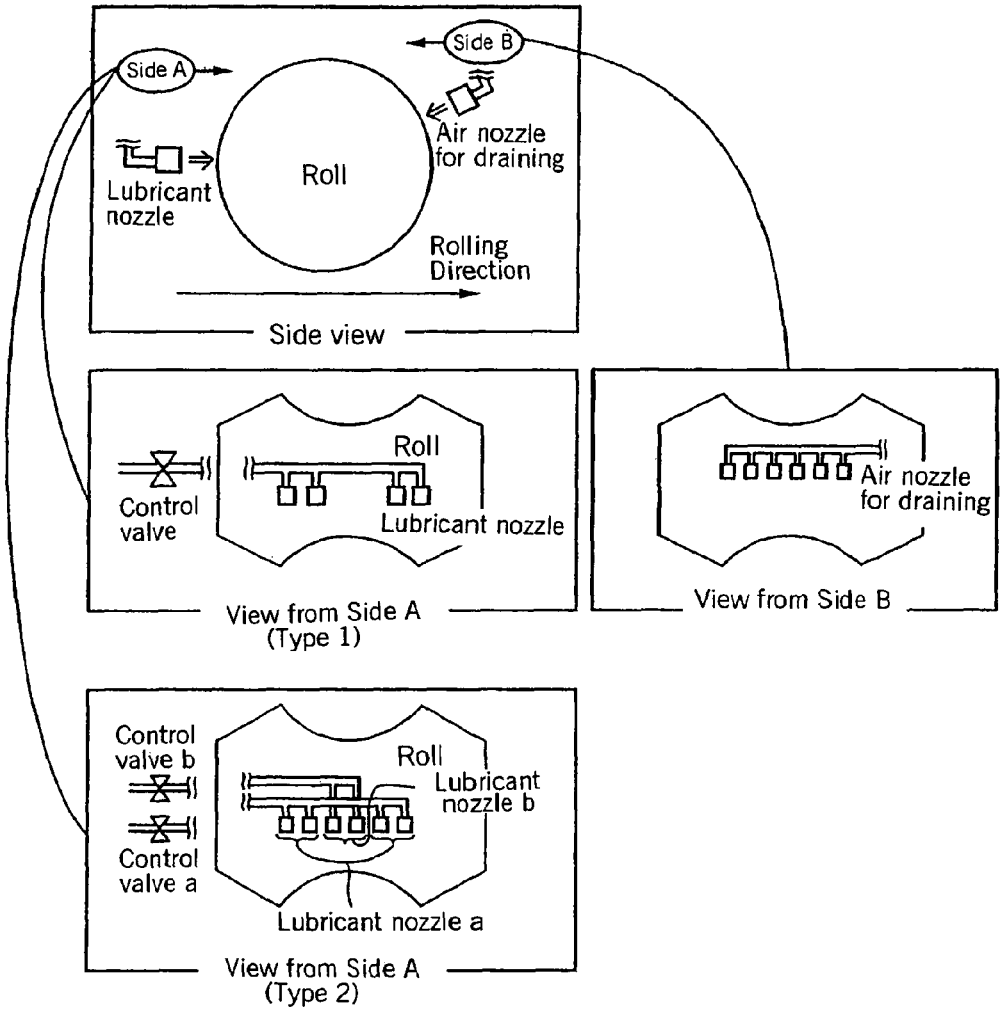
FIG. 9 is an explanatory view schematically showing two types (Type 1 and Type 2) of a lubricity modifier applicator.

FIG. 9 is an explanatory view schematically showing the structure of two examples (Type 1 and Type 2) of this lubricity modifier spraying unit. In Type 1, a single set of lubricating nozzles is provided to spray a lubricity modifier at the flange zones of the groove of a grooved roll. The amount of a lubricity modifier which is applied is controlled by a regulating valve. Type 2 has two sets of lubricating nozzles having independent regulating valves. Namely, it has a set of lubricating nozzles a which spray a lubricity modifier primarily at the flange zones, and another set of lubricating nozzles b which spray a lubricity modifier at the groove bottom zone. The type and/or applied amount of the lubricity modifier can be independently controlled for the two sets of nozzles. Of course, by providing three or more sets of regulating valves, it is possible to more finely control the applied amount of lubricity modifier on the roll surface of a groove, which is desirable.

The degree of opening of the regulating valves for controlling the applied amount of a lubricity modifier can be controlled manually, but the valves are preferably connected to and controlled by a computer. When there are a plurality of sets of lubricating nozzles, the type of lubricity modifier is preferably varied for each set, and application of the lubricity modifier is preferably carried out such that the lubricity modifier having the larger effect of decreasing the coefficient of friction is applied to the flanges.

The lubricity modifier which is applied may be a lubricant for rolling which is generally used in reducing of a pipe or an anti-slipping agent (i.e., friction increasing agent). The amount of a lubricity modifier which is applied to the groove surface may be varied in the roll axial direction. For example, a lubricity modifier may not be applied to the central portion in the roll axial direction (corresponding to at least a portion of the groove bottom zone), or the applied amount for that portion may be made smaller than for the flange zones (such as ⅓ thereof).

The lubricity modifier is preferably a combination of an anti-slipping agent which increases the coefficient of friction and a lubricating oil normally used for roll lubrication, but it is possible to use a lubricating oil alone.

The anti-slipping agent which can be used may be, for example, a silicone powder or a grease-based one. The lubricating oil may be a synthetic ester type. The mixing ratio and type of these conventional anti-slipping agent and lubricating oils can be suitably varied between the groove bottom zone and the flange zones.

When performing reducing of a plurality of types of pipe having different wall thicknesses or the like under different conditions in either of the above-explained first and second embodiments, the variation in the increase in wall thickness like that shown in FIG. 2 occurring under these rolling conditions is previously investigated, and the friction distribution in the roll axial direction of the groove surface of a grooved roll which is effective for minimizing the variation in wall thickness increase is determined. By setting the distribution of the surface roughness in the roll axial direction of the groove surface or applying a lubricity modifier such that this friction distribution is obtained, the variation in the wall thickness increase in the circumferential direction which is a direct cause of the occurrence of polygonization, can be suppressed, and the occurrence of polygonization can be essentially eliminated.

EXAMPLES

Three types of pipe having a diameter of 60 mm, a length of 400 mm, and a wall thickness of 12 mm, 8 mm, or 3 mm were subjected to reducing by cold rolling (drawing) using a model mill for reducing having four stands.

Case 1 was a comparative example using a grooved roll which was uniformly subjected to shot blasting over the entirety of the groove surface. Case 2 was an example of the present invention using a grooved roll which, as shown in FIG. 6, was divided into three equal regions along the circumference of the groove surface, with the groove bottom zone in the central one-third being subjected to shot blasting under the same conditions as described above, and with the groove surface having a friction distribution such that the frictional force with respect to a pipe of the groove bottom zone including the central portion in the roll axial direction was greater than the frictional force with respect to a pipe of the flange zones on both sides thereof. The motor rotational speed was set as shown in Table 1 with aiming to avoid tension between stands.

TABLE 1

| Stand | RPM |
|---|---|
| stand #1 | 579 |
| stand #2 | 570 |
| stand #3 | 562 |
| stand #4 | 556 |

Figure 10:
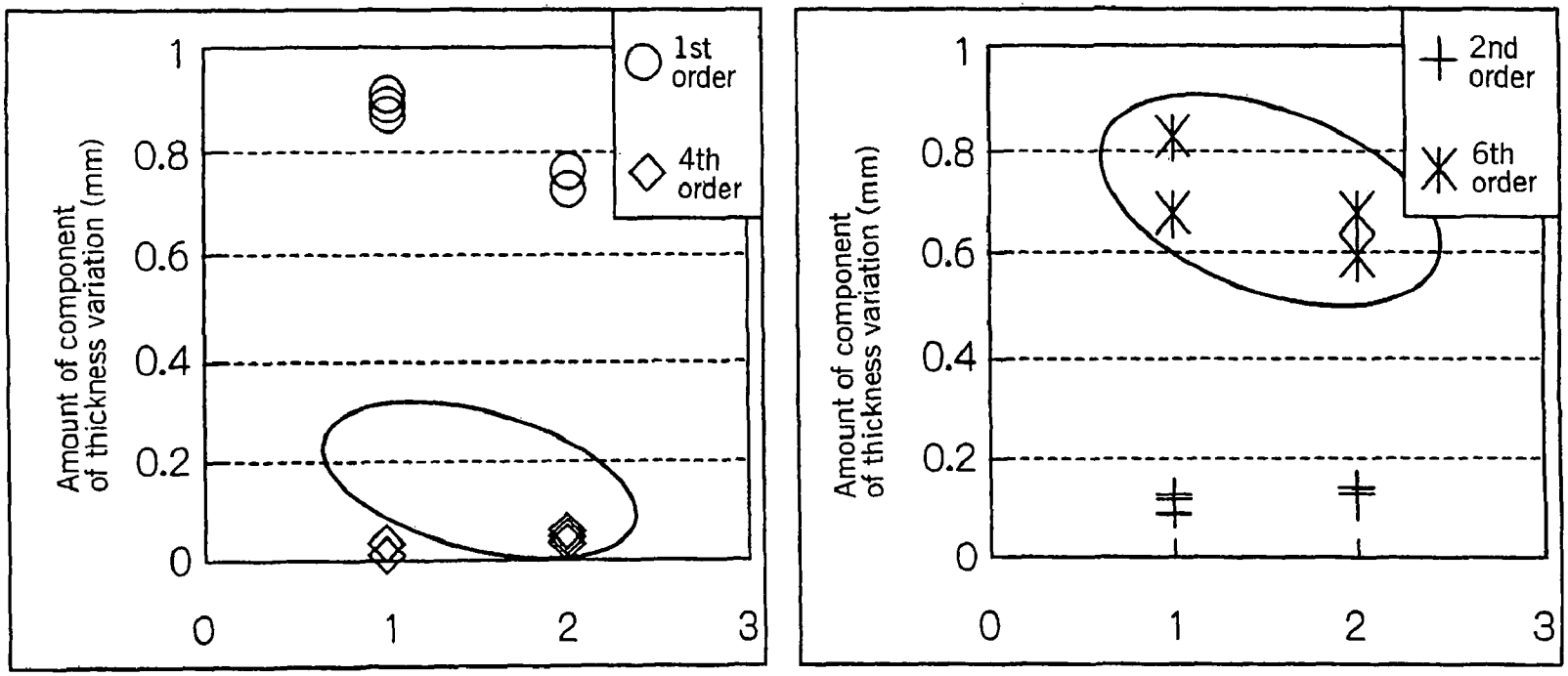
FIG. 10 shows graphs illustrating the magnitude of the components of thickness deviation which developed in each roll in an example.

FIG. 10 is a graph which compares the amounts of the components of thickness variation (first order, second order, fourth order, and sixth order component) for each roll in an example of the present invention and a comparative example. These components of thickness variation were obtained by frequency analysis using Fourier analysis of the circumferential distribution of the wall thickness. A component of wall thickness variation which varies one time in the circumference is a first order component, a component which varies two times is a second order component, and a component which varies n times is an nth order component.

As shown in FIG. 10, providing the above-described friction distribution of the groove surface has no effect on the second order component or the fourth order component of the roll friction distribution, but it decreases the sixth order component. As a result, the degree of thickness variation can be suppressed. The first order component is conjectured to be the caused by variation at the time of drawing.

Figure 11:
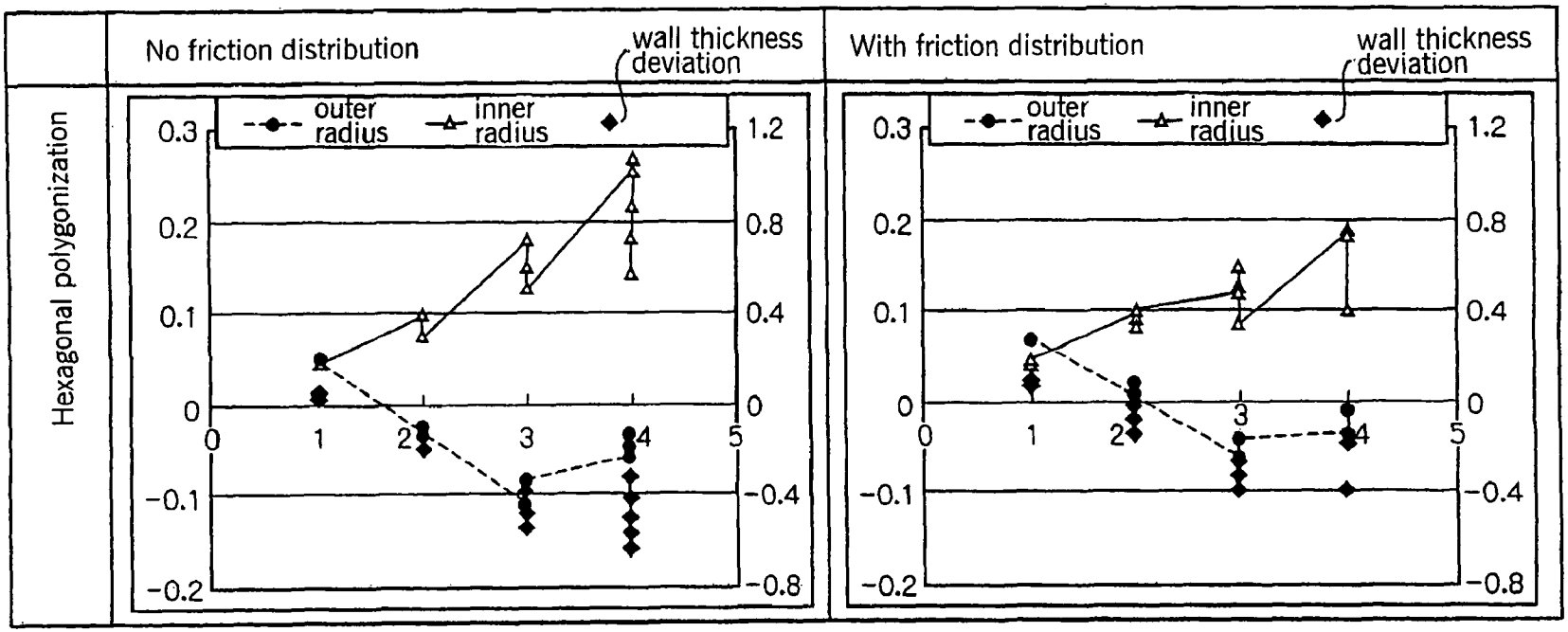
FIG. 11 shows graphs contrasting the change in the outer radius, the inner radius, and the thickness deviation (polygonization) of a pipe in each stand when carrying out reducing of a pipe with a wall thickness of 12 mm for a comparative example (no friction distribution) and an example according to the present invention (having a thickness distribution).
Figure 12:
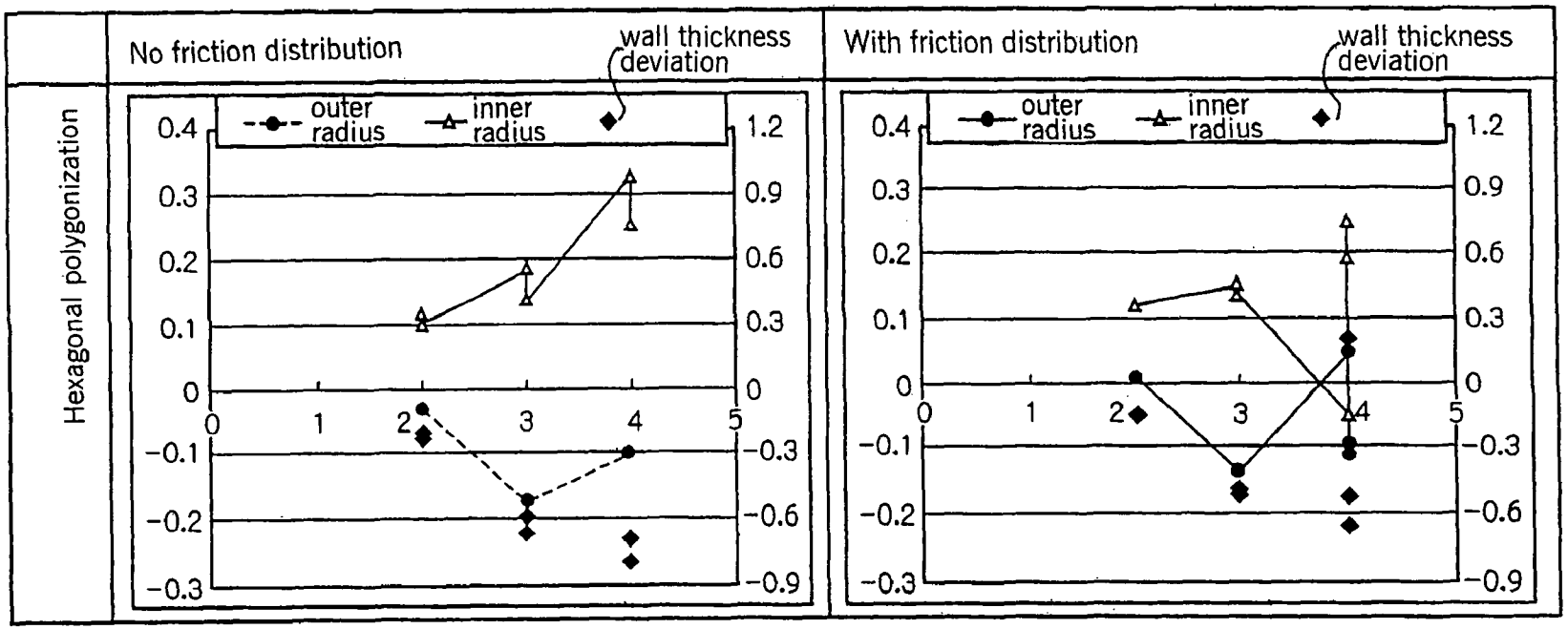
FIG. 12 shows graphs contrasting the change in the outer radius, the inner radius, and the thickness deviation (polygonization) of a pipe in each stand when carrying out reducing of a pipe with a wall thickness of 8 mm for a comparative example (no friction distribution) and an example according to the present invention (having a friction distribution).
Figure 13:
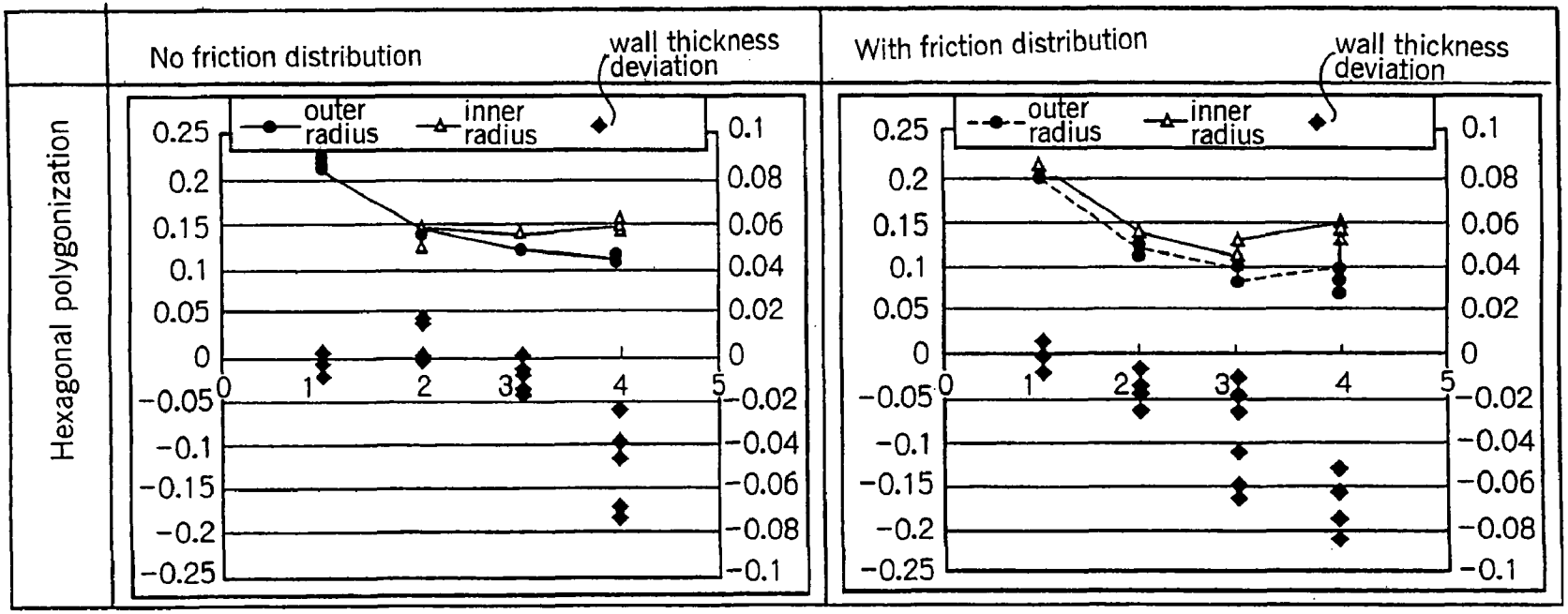
FIG. 13 shows graphs contrasting the change in the outer radius, the inner radius, and the thickness deviation (polygonization) of a pipe in each stand when carrying out reducing of a pipe with a wall thickness of 3 mm for a comparative example (no friction distribution) and an example of the present invention (having a friction distribution).

FIGS. 11, 12, and 13 are graphs showing changes in the outer radius, the inner radius, and the polygonization of the wall thickness of a pipe in each stand in an example of the present invention and a comparative example when the wall thickness of a mother pipe to be rolled was 12 mm, 8 mm, and 3 mm, respectively. In the graphs of FIGS. 11-13, in order to allow for comparison with positive and negative, only the component which takes extremums in the vertical direction (specifically the sixth order component) was extracted and the direction in which the value became thicker or larger was made positive.

As shown in the graphs of FIGS. 11-13, even when the wall thickness was varied among 12 mm, 8 mm, and 3 mm, the example of the present invention having a friction distribution was superior (with less thickness deviation) for all of the wall thicknesses with respect to the amount of increase of hexagonal polygonization to the comparative example, which did not have a friction distribution.

The invention claimed is:

1. A grooved roll for a reducer with a groove having a groove bottom zone including the center of the groove in a roll axial direction and flange zones adjoining both sides of the groove bottom zone, characterized in that a surface of the groove has a friction distribution in the roll axial direction such that a frictional force with respect to a material being rolled in the groove bottom zone is larger than the frictional force with respect to the material being rolled in the flange zones, wherein the groove bottom zone has a greater surface roughness than the flange zones and a coefficient of friction of the groove gradually decreases from the center in the roll axial direction towards end portions or the coefficient of friction gradually decreases from the center in the roll axial direction to some point on the flanges and remains constant at a low level.

2. The reducer characterized by having a grooved roll for a reducer as set forth in claim 1 and a friction distribution producing means for producing a friction distribution in the roll axial direction of the groove surface.

3. The reducer as set forth in claim 2 wherein the friction distribution producing means is a surface working device which can work a peripheral surface region of at least a portion in the axial direction of the groove surface so that the surface roughness of the groove bottom zone of the groove is different from the surface roughness of the flange zones thereof.

4. The reducer as set forth in claim 3 wherein the surface working device is an on-line roll grinding machine which can perform grinding of the grooved roll of a reducer while the roll is mounted in the reducer.

* * * * *